United States Patent [19]

Stratmann et al.

[11] 4,344,823

[45] Aug. 17, 1982

[54] DISCHARGING METHOD AND APPARATUS FOR DRY COKE COOLING CHAMBERS

[75] Inventors: Josef Stratmann; Klaüs Mrongowiüs, both of Recklinghausen, Fed. Rep. of Germany

[73] Assignee: Firma Carl Still GmbH & Co. KG., Fed. Rep. of Germany

[21] Appl. No.: 252,346

[22] Filed: Apr. 9, 1981

[30] Foreign Application Priority Data

Apr. 16, 1980 [DE] Fed. Rep. of Germany ..... 3014574

[51] Int. Cl.[3] ..... C10B 39/02; C10B 39/12; C10B 45/00

[52] U.S. Cl. ..... 201/41; 141/94; 141/131; 141/248; 202/228; 202/230; 202/269; 202/270

[58] Field of Search ..... 201/1, 39, 41; 202/227, 202/228, 230, 269, 270; 414/221, 199–206, 786; 141/248, 131, 94; 222/56, 330, 450

[56] References Cited

U.S. PATENT DOCUMENTS

| | | | |
|---|---|---|---|
| 1,483,187 | 2/1924 | Moetteli | 202/228 |
| 2,310,748 | 2/1943 | Pearson | 201/39 |
| 3,846,250 | 11/1974 | Knappstein et al. | 201/39 |
| 4,260,458 | 4/1981 | Weber et al. | 202/228 |
| 4,264,415 | 4/1981 | Galow et al. | 201/39 |
| 4,288,294 | 9/1981 | Velling | 202/228 |

FOREIGN PATENT DOCUMENTS

| | | | |
|---|---|---|---|
| 1173870 | 5/1959 | Fed. Rep. of Germany . | |
| 1071657 | 6/1960 | Fed. Rep. of Germany . | |
| 2209075 | 9/1973 | Fed. Rep. of Germany . | |
| 2538837 | 3/1977 | Fed. Rep. of Germany . | |
| 2601465 | 7/1977 | Fed. Rep. of Germany | 202/228 |

*Primary Examiner*—Bradley Garris
*Attorney, Agent, or Firm*—John J. McGlew

[57] ABSTRACT

A discharger is disclosed for a dry coke cooling chamber which utilizes a breeches chute having a plurality of outlets. The breeches chute is supplied with coke by a continuously operable conveyor which conveys coke from an outlet of the cooling chamber to an inlet of the breeches chute. A tilting table or other apparatus is provided in the breeches chute to selectively discharge the coke to one of the breeches chute outlets. A lock bin is provided at each of the outlets to receive coke and, at the same time to isolate the cooling chamber in a gas-tight fashion from the atmosphere.

4 Claims, 2 Drawing Figures

DISCHARGING METHOD AND APPARATUS FOR DRY COKE COOLING CHAMBERS

FIELD AND BACKGROUND OF THE INVENTION

The present invention relates in general to coke cooling chambers and equipment connected thereto, and in particular to a new and useful discharger for dry coke cooling chambers which can be operated substantially continuously and still maintain a gastight state for the cooling chamber.

Both continuously and discontinously operating discharger mechanisms are known. In German Pat. Nos. 2,209,075 and 2,538,837, for example, discontinuously operating dischargers are disclosed, which are each designed with two bins following each other and located below the discharge outlet of a coke cooling chamber. A gate is provided both between the cooling chamber and the upper bin and between the upper and lower bins, which gates are intended to withstand the weight of a coke charge and in addition, to close the opening in a gastight manner. The function of the upper gate is to periodically interrupt the flow of material and to close the cooling chamber in a gastight manner without interference from pieces of coke caught between the gate and the opening.

A discontinuous discharge of coke from the dry coke cooling chamber causes strong shocks in the cooling chamber and irregularities in the coke cooling process. The operational efficiency of a discontinuous discharge also is inferior to that of a continuous one.

In a continuous coke discharge from a coke cooling chamber, problems are caused by a simultaneous stopping of gas and material. A star wheel lock, provided in German Pat. No. 1,071,657 for example, causes an undesirable fragmentation of the coke and considerable stressing of the wheel material, so that after a short service time gastightness is no longer insured. The disturbance and repair quota is therefore, high.

Another device for continuous coke discharge from a dry coke cooling chamber is known from German Pat. No. 1,173,870. In this design the coke is directed by means of star cylinders into separate hoppers which are closed by a double water seal. The discharge volume per lock is very small and limited so that a larger number of star cylinders, hoppers and water seals is needed. Also, the water seals increase chances of corrosion.

SUMMARY OF THE INVENTION

The present invention is directed to a discharger for dry coke cooling chambers in which the mentioned problems do not arise, and which permits a continuous discharge of coke, with care, and while keeping the coking chamber gastight relative to the ambient air.

An object of the present invention accordingly, is to provide a discharge for a coke cooling chamber having an ante-chamber for receiving coke to be cooled, a cooling space downstream of the ante-chamber and an outlet for the coke downstream of the cooling space, comprising, an endless conveyor below the outlet adapted to be operated substantially continuously for conveying coke from the outlet, a breeches chute having a plurality of outlets connected at an output end of the endless conveyor for receiving coke therefrom, selective discharging means in the breeches chute for discharging coke through one of the plurality of chute outlets, a lock bin with at least one gastight gate connected at each chute outlet, and a common conveyor at outlet ends of each of the locked bins for receiving coke therefrom.

The particular advantage of this design over the prior art is that the gastight gates are not identical with the continuously discharging member, and that two or more bin locks are provided side by side and operating independently of each other. The gates and stoppers need to be operated only if the bins are empty, so that no disturbances due to clogging by coke pieces occur.

It is particularly advisable to design the reversing mechanism in the breeches chute as a tilting table pivotable about a central horizontal axis. Other reversing mechanisms known per se, such as suspended flaps, may also be used of course.

The discharger may be improved in accordance with the invention by providing temperature sensing means at the coke outlet from the chamber to control the conveyor. In this way, with the temperature of the coke exceeding a predetermined value, the discharge rate will be reduced, and if the temperature reaches a too high a level, endangering the following installations, such as the rubber belt of the conveyor, the discharge may be completely stopped.

Another development of the invention provides a level measuring device in the cooling chamber ante-chamber to control the conveyor. This makes it possible to control the coke discharge from the cooling chamber continuously to obtain, in normal operation, equal supply and discharge amounts in the cooling chamber. More particularly, a level measuring device located in the transition zone between the ante-chamber and the cooling space proper, may stop the endless conveyor to raise the level in the cooling space as required and to maintain, as long as possible, a steam production which might be provided downstream, if a disturbance in the hot coke supply occurs.

Advantageously, it is provided in accordance with the invention that, of an upper and lower gate, after the breeches chute, only the lower gate acts as a support and coke stopper. In this way, the upper gate is gastight, wherefore it can be of considerably simpler design and more reliable in service.

A further development of the invention provides that, below the discharge bin, a second conveyor is provided which has a capacity greater than a maximum capacity of the first mentioned conveyor. This makes sure that the bin locks can be emptied faster than supplied by the endless conveyor, and that the bin to be filled, is always empty. The contents of the locks cannot be amplified. Another advantage of the invention is that the lower gate need not be closed during the flow of coke therethrough. Therefore, a simple, only gastight gate, can be provided. No risk of fragmenting the coke is incurred either. The inventive design makes it further possible to provide a relatively low construction of the locks, and thus to avoid an undesirable height of the coke drop in the locks. This of course leads to substantially less expensive construction as compared to the prior art. The inventive system further offers a maximum safety since the coke cannot flow out of the cooling space in an uncontrolled manner, for example, upon a power failure. In such a case, the upper conveyor stops and no further coke flows out of the cooling chamber.

Another object of the invention is to provide a method for discharging coke, in a substantially continuous manner, from a dry coke cooling chamber comprising, using an endless conveyor adapted for continuous operation for moving coke from an outlet of the coke cooling chamber to an output end of the endless conveyor, feeding coke from the output end of the endless conveyor into a breeches chute which includes a plurality of breeches chute outputs, selectively feeding the coke entering the breeches chute to one of the plurality of breeches chutes, feeding the coke from the one output of the breeches chute into a lock bin having at least one gastight gate for isolating the dry coke cooling chamber from the ambient, and discharging the coke from a lock bin which has received coke onto a common conveyor.

A still further object of the invention is to provide such a discharger which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

The invention is illustrated in the drawings in which.

DESCRIPTION OF THE PREFERRED EMBODIMENT

Figure 1:
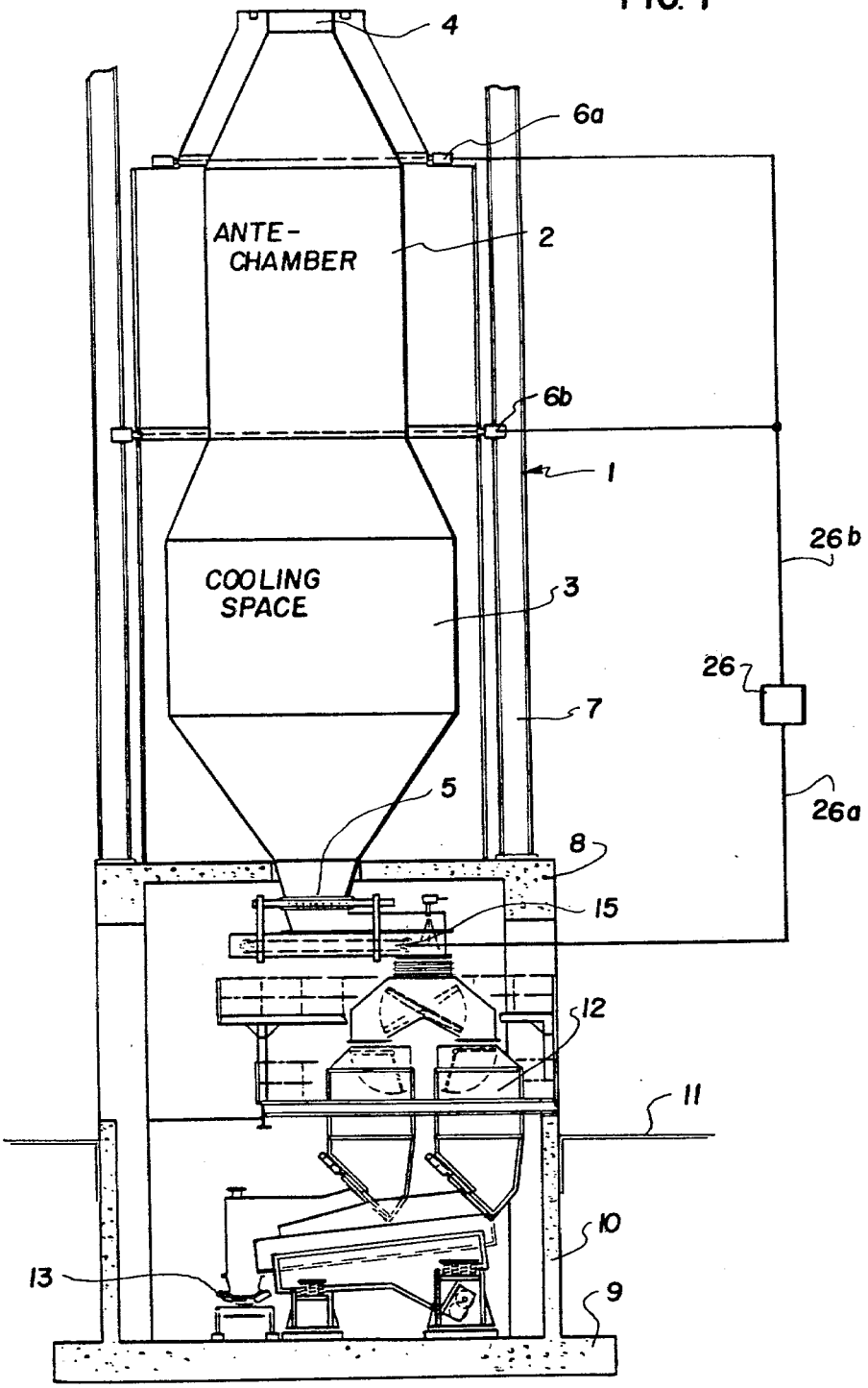
FIG. 1 is a diagramatical overall view of a dry coke cooling plant with an ante-chamber, cooling chamber, and discharger.

Turning to the drawings in particular, the invention embodied therein, in FIG. 1 is a dry coke cooling apparatus generally designated 1 which is provided with a discharge at the lower end thereof which can discharge coke from the assembly in a continuous manner while still maintaining a gastight seal between the interior of the apparatus and the ambient atmosphere.

The dry cooling section generally designated 1, comprises an ante-chamber 2, a cooling space or chamber 3, a charging hole 4, a chamber outlet 5, level measuring devices 6*a*, 6*b*, for the maximum and minimum levels, a supporting frame 7, and the structural base and foundation 8 to 10. The ground is indicated at 11. Further shown are the discharging bin locks 12 and a conveyor belt 13 for cooling coke, a needle gate 14 (FIG. 2) for outlet 5 including a structure for displacing a chain conveyor 15, a bellows 16 compensating for extensions between the dry cooling section 1 and the bin 12, a breeches chute 17 accommodating a tilting table 17*a* pivotable about an axis 17*b*, bins 18 of the locks 12, gastight inlet gates for locks 12, combined material and gas gates or stoppers 20, a shaker loader 21 with a drive 22, a dust hood 23, a temperature sensor 24, pedestals 25, the control device 26 (FIG. 1) which is connected through lines 26*a*, 26*b* to chain conveyor 15 and to level measuring devices 6*a*, 6*b* and a control device 27 (FIG. 2) which is connected through lines 27*a*, 27*b* to temperature sensor 24 and to endless conveyor 15.

The operation of the plant is as follows:

Coke which must be cooled is supplied through the charging hole 4 into the ante-chamber 2. The coke then progresses from the ante-chamber 2 into the cooling space 3. As coke fills the cooling space 3 and part of the ante-chamber 2, this filling is sensed by the level sensing or measuring devices 6*a* and 6*b*.

Figure 2:
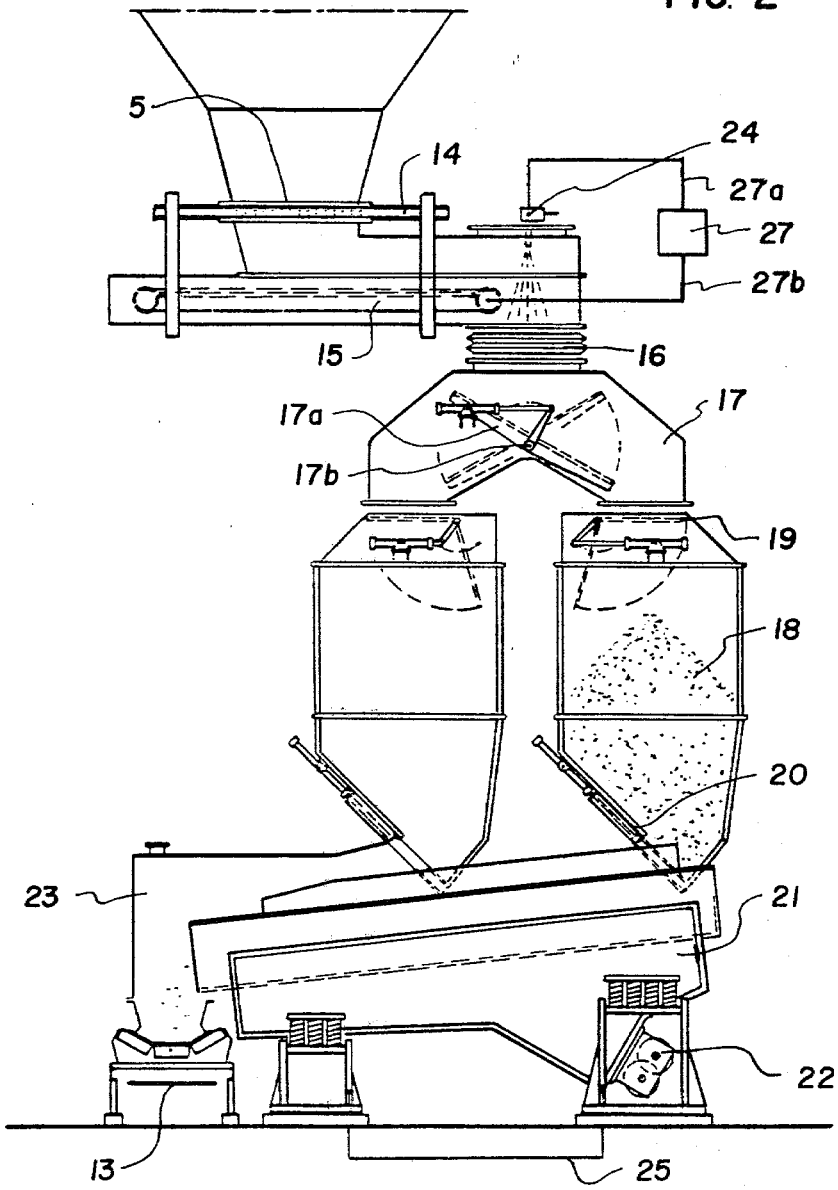
FIG. 2 is a diagramatical view of the discharger with bin locks.

From the cooling space 3 the coke descends through the outlet 5 and onto the conveyor 15 which is adapted for continuous movement and feeding of coke from the outlet 5. Then, turning to FIG. 2, the coke proceeds down into a breeches chute 17 which is provided with a plurality of outlets. Two are shown in this embodiment of the invention. A selective discharging means exemplified by tilting table 17*a* is provided in the chute to selectively supply the coke from the conveyor 15 into one of the two bins 18. With the tilting table 17*a* tilted to the right, the gastight gate 19 is opened with the stopper gate 20 closed to fill in bin 18. With bin 18 filled, the tilting table 17*a* is tilted to the right and gastight door 19 on the left hand bin is closed while gastight door 19 on the left hand bin as shown in FIG. 2 is opened. The lower stopper gate of the left bin 18 is closed to permit the left bin to fill. At some time during this filling, the stopper gate 20 on the right hand bin 18 can be opened to release its contents onto the shaker 21. The contents are then dropped onto the common conveyor 13 and conveyed away. A gastight seal has always been maintained by the lock bins 18 since, at any one time, only one of the gates 19 and 20 open.

If coke is being discharged from the cooling chamber or space 3, too rapidly, this will be picked up by an over-temperature in the temperature sensor 24 and the information conveyed to the conveyor through control 27 in the form of a signal to reduce the speed of conveyor 15. Conversely, if the coke is being removed from the cooling space too slowly, this causes an under-temperature as sensed by the temperature sensor 24 which controls the conveyor 15 through control 27 to increase its operation. Such increase and decrease of operation can also be initiated if there is too great or too little a filling of the cooling chamber device as indicated by the level sensors 6*a* and 6*b*. With too great an amount of coke in the chamber, which is represented by a signal from sensor 6*a* indicating that coke has backed up into the charging area of the chamber, the speed of conveyor 15 can be increased. With too small an amount of coke in the chamber as indicated by a signal from sensor 6*b*, the operation of conveyor 15 can be slowed.

While a specific embodiment of the invention has been shown and described in detail to illustrate the application of the principle of the invention, it will be understood that the invention may be embodied otherwise without departing from such principles.

What is claimed is:

1. A method of discharging coke from a dry coke cooling chamber having an ante-chamber for receiving coke to be cooled, a cooling space downstream of the ante-chamber and an outlet for the coke downstream of the cooling space, comprising the steps of:

feeding coke from the cooling chamber outlet to an inlet of a breeches chute, continuously on an endless conveyor;

selectively discharging coke fed to the breeches chute to one of a plurality of outlets of the breeches chute;

providing a lock bin at each outlet of the breeches chute having a pair of gastight gates, an upper one of the gates provided with a slighter structure than the lower one so that the lower one only is adapted to support coke thereon;

opening an upper one of the gastight gates only when coke is discharged from the breeches chute into that one of the lock bins having the open upper gastight gate;

holding a lower gastight gate of the lock bin closed as coke fills into the lock bin through the open upper gastight gate; and opening the lower gate when the upper gate is closed to discharge coke from the lock bin which now has a closed upper gate.

2. A discharger for a coke cooling chamber having an ante-chamber for receiving coke to be cooled, a cooling space downstream of the ante-chamber and an outlet for the coke downstream of the cooling space, comprising:

an endless conveyor below the cooling chamber outlet adapted to be operated substantially continuously for conveying coke from the cooling chamber outlet;

a breeches chute having a plurality of chute outlets connected to an output end of said endless conveyor for substantially continuously receiving coke therefrom;

selective discharging means in said breeches chute having a plurality of positions, each for discharging coke from said chute through one of said plurality of chute outlets;

a lock bin connected to each of said chute outlets having at least two gastight gates; and a common conveyor positioned to receive coke from all of said lock bins;

each respective one of said lock bins having an upper gastight gate which is opened for receiving coke from said discharging means only when said discharging means is in one of its positions to discharge coke to the respective one of said lock bins, and a lower gastight gate which is closed for supporting and holding coke in said respective lock bin as it is fed to said respective lock bin from said discharging means;

said upper gate being lightly structured with respect to said lower gate so as not to be adapted for supporting coke thereon.

3. A discharger according to claim 1, wherein said selective discharging means comprises a tilting table, said breeches chute having at least two outlets.

4. A discharger according to claim 3, including control means connected to said endless conveyor for increasing and decreasing operation thereof, a temperature sensor at the output end of said endless conveyor for sensing the temperature of coke discharged from said endless conveyor, level sensing means in the ante-chamber of the coke cooling chamber, said temperature sensor and level sensing means connected to said control means for selectively increasing and decreasing the operation of said endless conveyor.

* * * * *